US010737915B2

(12) United States Patent
Mohr

(10) Patent No.: US 10,737,915 B2
(45) Date of Patent: Aug. 11, 2020

(54) LIFTING APPARATUS FOR RAISING AND LOWERING HEAVY OBJECTS

(71) Applicant: Mohr Lizenz Verwaltungs GmbH, Bielefeld (DE)

(72) Inventor: Christoph Mohr, Bielefeld (DE)

(73) Assignee: Mohr Lizenz Verwaltungs GmbH, Bielefeld (DE)

( * ) Notice: Subject to any disclaimer, the term of this patent is extended or adjusted under 35 U.S.C. 154(b) by 65 days.

(21) Appl. No.: 16/120,934

(22) Filed: Sep. 4, 2018

(65) Prior Publication Data

US 2019/0092605 A1 Mar. 28, 2019

(30) Foreign Application Priority Data

Sep. 28, 2017 (EP) ..... 17193838

(51) Int. Cl.
*B66C 13/06* (2006.01)
*B66C 13/08* (2006.01)
*B66C 19/00* (2006.01)

(52) U.S. Cl.
CPC ..... *B66C 13/06* (2013.01); *B66C 13/08* (2013.01); *B66C 19/00* (2013.01); *B66C 2700/012* (2013.01)

(58) Field of Classification Search
CPC ..... B66C 13/06; B66C 13/08; B66C 19/00; B66C 2700/012
See application file for complete search history.

(56) References Cited

U.S. PATENT DOCUMENTS 300,344 A * 6/1884 Chamblin ..... B66D 1/26 254/286
982,883 A * 1/1911 Schnabel ..... B66C 13/00 212/327
1,419,129 A * 6/1922 Fitch ..... B66C 7/00 212/171
2,164,128 A * 6/1939 Medenwald ..... B66C 13/06 182/36
3,276,602 A * 10/1966 Vogeley ..... B66C 13/06 212/274
3,598,440 A * 8/1971 Ramsden ..... B66C 1/101 294/81.3

(Continued)

FOREIGN PATENT DOCUMENTS

EP 1106563 A2 6/2001

*Primary Examiner* — Michael E Gallion
(74) *Attorney, Agent, or Firm* — Laurence P. Colton; Smith Tempel Blaha LLC

(57) ABSTRACT

A lifting apparatus for raising and lowering objects has two frame assemblies positioned one above the other, so as to be mutually parallel, with respect to a vertical direction, the lower frame assembly suspended on the upper frame assembly using lifting traction means, such that the lower frame assembly can be drawn up towards the upper frame assembly by winding the lifting traction means, and the lower frame assembly can be lowered relative to the upper frame assembly by unwinding the lifting traction means. The lifting apparatus has oblique traction means extending between the frame assemblies that can be wound and unwound using a tensioning device, two of which mutually intersect such that the lower frame assembly is stabilized, relative to the upper frame assembly, in at least one deflection direction transverse to the vertical direction.

12 Claims, 5 Drawing Sheets

(56) References Cited

U.S. PATENT DOCUMENTS 3,653,518 A * 4/1972 Polen ..... B66C 13/06 212/330
3,746,182 A * 7/1973 Tax ..... B66C 13/06 212/274
3,837,503 A * 9/1974 Komatsu ..... B66C 13/00 212/83
3,842,986 A * 10/1974 Hupkes ..... B66C 13/06 212/330
3,887,080 A * 6/1975 Wilson ..... B66C 11/02 212/318
3,899,083 A * 8/1975 Flessner ..... B66C 13/06 212/274
3,971,478 A * 7/1976 Matasa ..... B66C 1/24 212/274
4,531,647 A * 7/1985 Higuchi ..... B66C 13/06 212/274
4,544,070 A * 10/1985 Sickler ..... B66C 13/06 212/273
4,563,030 A * 1/1986 Makino ..... B66C 13/06 212/274
4,883,184 A * 11/1989 Albus ..... B66C 13/06 212/274
4,953,721 A * 9/1990 Foit ..... B66C 13/06 212/274
5,074,528 A * 12/1991 Long, Jr. ..... B66C 19/00 254/285
5,257,891 A * 11/1993 Baumann ..... B66C 1/101 212/274
5,765,703 A * 6/1998 Shiwaku ..... B66C 13/08 212/274
6,023,862 A * 2/2000 Sirjola ..... B66C 3/125 212/320
6,126,023 A * 10/2000 Durrant-Whyte ..... B66C 13/06 212/274
6,382,437 B1 * 5/2002 Okada ..... B66C 13/06 212/274
6,826,452 B1 * 11/2004 Holland ..... B66C 1/663 318/566
7,287,740 B2 * 10/2007 Reyes ..... B66C 13/06 212/274
9,315,244 B2 * 4/2016 Kalkman ..... B63B 27/12
9,527,707 B1 * 12/2016 Fehringer ..... B66F 7/26
9,908,750 B2 * 3/2018 Sturm, Jr. ..... B66C 11/08
10,016,891 B2 * 7/2018 Reid ..... B25J 9/0078
2003/0168647 A1 * 9/2003 Thompson ..... B66C 13/46 254/270
2005/0024005 A1 * 2/2005 Rodnunsky ..... B66C 13/08 318/649
2007/0114505 A1 * 5/2007 Reyes ..... B66C 13/06 254/278
2007/0158290 A1 * 7/2007 Lerchenmueller ..... B66C 13/06 212/274
2008/0121601 A1 * 5/2008 Ehrenleitner ..... B66C 1/20 212/76
2009/0066100 A1 * 3/2009 Bosscher ..... B25J 17/0266 294/86.4
2013/0238135 A1 * 9/2013 Fisher ..... B66C 21/00 700/275
2018/0029849 A1 * 2/2018 Beer ..... B66C 13/08
2018/0134420 A1 * 5/2018 Kwon ..... F16H 7/08

* cited by examiner

LIFTING APPARATUS FOR RAISING AND LOWERING HEAVY OBJECTS

CROSS REFERENCE TO RELATED APPLICATIONS

This application claims priority on and the benefit of European Patent Application No. 17193838.4 having a filing date of 28 Sep. 2017.

BACKGROUND OF THE INVENTION

Technical Field

The invention relates to a lifting apparatus for raising and lowering in particular heavy objects, comprising two frame assemblies that are positioned one above the other with respect to a vertical direction, the lower frame assembly of which is suspended on the upper frame assembly using lifting traction means, such that winding of the lifting traction means allows the lower frame assembly to be drawn up towards the upper frame assembly by means of a raising/lowering device, and subsequent unwinding of the lifting traction means allows said lower frame assembly to be lowered relative to the upper frame assembly.

Prior Art

Lifting apparatuses are used for raising and lowering objects vertically with respect to a vertical direction. Depending on the design and weight of the objects to be moved, said lifting apparatus can be operated both manually or by a motor. In addition to manipulation in the vertical direction, lifting apparatuses of this kind usually also provide the possibility of displacement in at least one transverse direction, such that a suspended object can be raised at one location and placed down again at another location. This may be achieved for example by rotating a side arm of the lifting apparatus and/or by lateral linear displacement thereof.

In particular stationary lifting apparatuses may be combined with an overhead track in order to displace the relevant lifting apparatus along a path that is usually structurally fixed. When arranged within a plant or on plant premises or at container handling facilities, it is thus possible to also move heavy loads such as containers or vehicles.

EP 1 106 563 A2 discloses a lifting apparatus comprising two frame assemblies that are positioned one above the other with respect to a vertical direction, the lower frame assembly of which is suspended on the upper frame assembly using a plurality of lifting traction means, such that winding of the lifting traction means allows the lower frame assembly to be drawn up towards the upper frame assembly by means of a raising/lowering device, and subsequent unwinding of the lifting traction means allows said lower frame assembly to be lowered again relative to the upper frame assembly, and vice versa. In this case, the two frame assemblies can preferably be mutually parallel, in order to achieve a design that is as compact as possible overall, based on the state in which the lower frame assembly is fully drawn up.

The known lifting apparatus has an economical and in particular space-saving design, allowing for simple raising and lowering. Simultaneously using a plurality of lifting traction means that are at a parallel spacing already reduces otherwise entirely uncontrolled rotation of the object suspended in each case. In order to minimize, as far as possible, any pendular movements that may be triggered by lateral deflection when the lifting apparatus, equipped with a drive unit, is started up or braked, the individual lifting traction means are in addition deflected a plurality of times, in part. The deflections achieve a kind of crossover between the lateral portions that are positioned above one another. In this way, the rectangular lateral planes of the lifting apparatus, composed in each case of two lifting traction means and the associated lateral portions of the two frame assemblies, are intended to be protected from slanting to become a parallelogram and thus allowing relative movement between the two frame assemblies in the horizontal direction.

As a result, although the lifting traction means are deflected in a triangular manner, the tips of said triangle shape located in the region of the lower frame assembly are not fixed. In other words, this also furthermore makes it possible for the lower frame assembly, suspended quasi in said tips of the lifting traction means by deflecting rollers, to be retained from lateral deflections only to a limited extent.

BRIEF SUMMARY OF THE INVENTION

The object of the present invention is therefore that of developing a generic lifting apparatus such that said apparatus has increased stability with respect to lateral deflections, in particular also with respect to rotational movements, resulting therefrom, about a vertical direction.

This object is achieved according to the invention by a lifting apparatus for raising and lowering in particular heavy objects, comprising two frame assemblies that are positioned one above the other with respect to a vertical direction, the lower frame assembly of which is suspended on the upper frame assembly using lifting traction means, such that winding of the lifting traction means allows the lower frame assembly to be drawn up towards the upper frame assembly by means of a raising/lowering device, and subsequent unwinding of the lifting traction means allows said lower frame assembly to be lowered relative to the upper frame assembly, characterized by oblique traction means that extend between the two frame assemblies and can be wound and unwound using a tensioning device, and two of which in each case mutually intersect such that the lower frame assembly is stabilized, relative to the upper frame assembly, in at least one deflection direction that extends transversely to the vertical direction, the tensioning device being able to retain each of the oblique traction means under tensile stress during winding and unwinding of the lifting traction means. The dependent claims relate to advantageous embodiments.

In this case, the invention is based on the underlying concept that the raising and lowering based on unwinding and winding the lifting traction means, i.e. in this respect the lift of the lifting apparatus, is achieved purely by the lifting traction means, while the necessary stability is intended to result from additional traction means that are uncoupled from the lifting traction means. For this purpose, it is proposed to provide additional traction means, which means extend between the two frame assemblies, in the sense of oblique traction means. Two of said oblique traction means in each case mutually intersect such that the lower frame assembly is stabilized, relative to the upper frame assembly, in at least one deflection direction that extends transversely to the vertical direction. In other words, in this case the stabilizing crossover of the lateral planes is achieved not by means of multiple deflections of the lifting traction means, but instead by using additional oblique traction means provided specifically for this purpose.

In order for it to be possible to follow the spacing between the two frame assemblies, which spacing varies in the event of lifting of the lifting apparatus, by corresponding changes in length of the oblique traction means, it is proposed to provide a tensioning device in addition to the raising/lowering device. The tensioning device is intended to accordingly wind or unwind the oblique traction means if required, in order to bring about the necessary change in length thereof during a lift of the lifting apparatus. In this case, the tensioning device is designed and formed such that the tensioning device can retain each of the oblique traction means under tensile stress during winding and unwinding of the lifting traction means.

The resulting advantage is that it is now possible for the individual traction means to be controlled in a manner mechanically uncoupled from one another. When carrying out the intended use thereof, said traction means are now deliberately divided into lifting traction means and oblique traction means that are physically separated therefrom. The uncoupling makes it possible to actuate the oblique traction means independently of the lifting traction means, such that a tension that brings about the stabilization with respect to lateral pendulum movements can always be applied to the oblique traction means.

For this purpose, the oblique traction means are subjected to a tensile force that is for example continuously constant and that does not allow any uncontrolled lengthening of one side of the triangle shape, formed by the crossover, between the lifting and oblique traction means.

In this case, various embodiments of the course of the oblique traction means, in practice, are possible. For example, it is possible for one oblique traction means to for example reach upwards from a front left-hand corner region of the lower frame assembly to a rear right-hand corner region of the upper frame assembly, while another oblique traction means extends upwards from a rear left-hand corner region of the lower frame assembly to a front right-hand corner region of the upper frame assembly. In this way, the intersection of the two oblique traction means occurs virtually at the center point between the two frame assemblies.

The intersections of the oblique traction means can preferably be achieved such that said means define the space stretching between the two frame assemblies so as to be parallel to the sides thereof, and in this sense do not cross the space.

According to a particularly preferred development of the underlying inventive concept, each of the two frame assemblies can comprise at least three, in particular four, lateral portions in each case. This results in a substantially triangular or rectangular basic shape of the two frame assemblies. At least two oblique traction means can then advantageously extend between at least one of the lateral portions of the lower frame assembly and a lateral portion of the upper frame assembly that is located thereabove with respect to the vertical direction, which oblique traction means intersect on their path between the associated lateral portions of the two frame assemblies. The advantage of this embodiment is that the oblique traction means are as short as possible, and therefore the sometimes intrinsic resilient length-variability thereof can be largely compensated for and/or subsequent adjustment of the tension using the tensioning device is simplified.

Advantageously, at least two oblique traction means may be arranged in each lateral region of the space stretching between the two frame assemblies, which oblique traction means then each extend between a lateral portion of the lower frame assembly and a lateral portion of the upper frame assembly that is located thereabove with respect to the vertical direction, and intersect in the process. As high as possible a degree of stability of the lower frame assembly, in all transverse directions, with respect to the upper frame assembly is achieved in this manner, and therefore undesired pendulum movements and/or rotations, which are otherwise possible, between the frame assemblies are reduced to a minimum or even prevented entirely.

The raising/lowering device provided for winding and unwinding the lifting traction means may comprise at least one lifting drive which is coupled for torque transmission to a lifting shaft. The controlled rotation, thus possible, of the lifting shaft about the longitudinal axis thereof is used for winding and unwinding the lifting traction means, then connected to the lifting shaft, about the lifting shaft at least in part. For this purpose, the lifting shaft may be coupled to the lifting drive either directly or indirectly, for example by means of interposing at least one further component.

The tensioning device may comprise at least one tensioning drive which is coupled for torque transmission to at least one tensioning shaft. The controlled rotation, thus possible, of the at least one tensioning shaft about the longitudinal axis thereof is used for winding and unwinding the oblique traction means, then connected to the tensioning shaft, about the tensioning shaft at least in part. For this purpose, the at least one tensioning shaft may be coupled to the tensioning drive either directly or indirectly, for example by means of interposing at least one further component.

According to a development of the tensioning device, said device may comprise at least two separate tensioning shafts which are coupled for torque transmission to the at least one tensioning drive. For this purpose, each of the at least two tensioning shafts may be coupled to the tensioning drive either directly or indirectly, for example by means of interposing at least one further component in each case. As a result, at least two of the oblique traction means can in each case be at least in part wound around and unwound from one of the two tensioning shafts in each case.

Particularly preferably, the tensioning device may comprise a total of four separate tensioning shafts which are coupled for torque transmission to the at least one tensioning drive. For this purpose, each of the four tensioning shafts may be coupled to the tensioning drive either directly or indirectly, for example by means of interposing at least one further component in each case. As a result, at least two of the oblique traction means can in each case be at least in part wound around and unwound from one of the four tensioning shafts in each case.

With regard to equipping the tensioning device with at least two or four tensioning shafts, it is considered to be particularly advantageous for said shafts to be coupled together for torque transmission by means of a transmission unit. The transmission unit makes it possible for the acting torque to be applied synchronously to all the tensioning shafts coupled thereto. In this context, the tensioning drive designed for generating the necessary torque may preferably be integrated between one of the tensioning shafts and the transmission unit. Of course, alternative embodiments thereto are also conceivable, in which the tensioning drive can be connected for torque transmission, for example directly or indirectly, only to the transmission unit. In any case, this results in far more economical structure that requires just one tensioning drive.

In a possible alternative embodiment of the tensioning device, said device may comprise a total of three or preferably four separate tensioning drives which are then each coupled to a tensioning shaft. Providing a plurality of tensioning drives has the advantage that the tensile force required in each case is always applied to the oblique traction means, connected to the tensioning shaft, in a mutually independent manner. This may be expedient for example when anticipated deflections can be better compensated for by deliberate actuation of the individual tensioning drives. Furthermore, the necessary power, and thus the dimensions, of each individual tensioning drive may be smaller. It is possible in principle for at least two of the oblique traction means in each case to be able to be wound around and unwound from one of the four tensioning shafts at least in part. In this case, these are particularly advantageously mutually intersecting oblique traction means in each case, and therefore the individual sides of the space stretching between the two frame assemblies can be controlled in a mutually independent manner, by one of the tensioning drives in each case.

With regard to the necessary attachment of the individual traction means to the frame assemblies, it is considered to be particularly advantageous for each of the oblique traction means to be rigidly attached to the lower frame assembly. Significantly better control of the stability of the lower frame assembly is achieved by the omission of any deflecting rollers for the otherwise conventional deflection of the traction means. In order to maintain as effective as possible a crossover between the two frame assemblies, using the oblique traction means, the angle enclosed in each case between a lateral portion of the lower frame assembly and an oblique traction means connected thereto should be small even in the most extreme lowered position (largest spacing between upper and lower frame assembly). This brings about a sufficient horizontal component of the tensile force to be applied to the oblique traction means to compensate as far as possible for any pendulum movements. Against this background, it is possible that the oblique traction means in question may be fastened to the lower frame assembly in the region of a corner thereof located between two of the lateral portions thereof in each case.

One lateral portion of the lower frame assembly in each case, and the lateral portion of the upper frame assembly that is located thereabove with respect to the vertical direction together span a lateral plane, it preferably being possible for each of the oblique traction means to be able to extend diagonally, said lateral plane or within a plane extending in parallel with the associated lateral plane, from the lower frame assembly towards the upper frame assembly. Advantageously, in this case the oblique traction means can extend as far as a region of an upper corner located between two lateral portions of the upper frame assembly in each case.

In a development of the above-described arrangement of the oblique traction means and the course thereof, it is considered to be particularly advantageous for each of the oblique traction means to be hinged, on the upper frame assembly, to a central portion of the relevant lateral portion. It is thus possible for every oblique traction means to then be able to be connected to a tensioning shaft of the tensioning device located in the region of the associated central portion. As a result, the two oblique traction means that intersect in each case may in principle be associated with just one tensioning shaft, such that said traction means can always be synchronously wound and unwound and/or subjected to the required tensile force.

The lifting traction means can particularly preferably all be rigidly attached to the lower frame assembly. Significantly better control of the stability of the lower frame assembly is achieved by the omission of any deflecting rollers for the otherwise conventional deflection of the traction means.

In order to maintain as stable as possible a connection between the lower frame assembly and the upper frame assembly, the lifting traction means may preferably be fastened to the lower frame assembly in the region of a lower corner thereof located between two of the lateral portions thereof in each case. Each of the lifting traction means can then extend therefrom towards the upper frame assembly. In this case, the individual lifting traction means can particularly preferably extend between the two frame assemblies so as to be in parallel with the vertical direction, such that the entire tensile force existing in the lifting traction means is available for the required lift of the lower frame assembly.

In this connection, it is considered to be particularly advantageous for each of the lifting traction means to be hinged, on the upper frame assembly, to a central portion of the relevant lateral portion. It is thus possible for every lifting traction means to then be able to be connected to a lifting shaft of the raising/lowering device located in the region of the associated central portion. As a result, the lifting traction means can all be associated with just one tensioning shaft, such that the lifting traction means can always be wound and unwound synchronously.

An embodiment of this kind allows for far more economical design and operation of the raising/lowering device.

The individual traction means, i.e. the lifting and/or oblique traction means, can all be designed so as to be different from or identical to one another. Preferably, all or at least some of the traction means can thus be a belt or band or cable. Of course, combinations thereof are also conceivable, i.e. for example constructing a single traction means from a belt and a cable. Said belt and cable may contain metal and/or plastics and/or natural fibers for example or be formed of at least one thereof.

The lifting apparatus according to the invention, now described, has extremely advantageous properties with regard to the stability of the lower frame assembly relative to the upper frame assembly. The known tendency of suspended structures of this kind for lateral deflections and/or rotational movements about a vertical direction is achieved according to the invention by specific distribution, and in this respect physical separation, of the individual traction means. The task of the lifting traction means is therefore now purely that of raising and lowering the lower frame assembly, while the oblique traction means that are uncoupled from the lifting traction means are intended only for stabilizing the lower frame assembly relative to the upper frame assembly. Owing to the mutually separate actuation of the traction means, divided in this manner, by the raising/lowering device and the tensioning device, it is possible to always keep the oblique traction means, used for stabilization, at the required length, and to apply thereto the tensile force required in each case. Any interactions due to deflections of the traction means for the purpose of their otherwise combined fulfillment of said task (raising, lowering and stabilization) are reliably excluded thereby.

BRIEF DESCRIPTION OF THE DRAWINGS

The invention will be explained in greater detail in the following, with reference to an embodiment shown in the drawings. In the drawings.

DETAILED DESCRIPTION OF PREFERRED EMBODIMENTS

Figure 1:
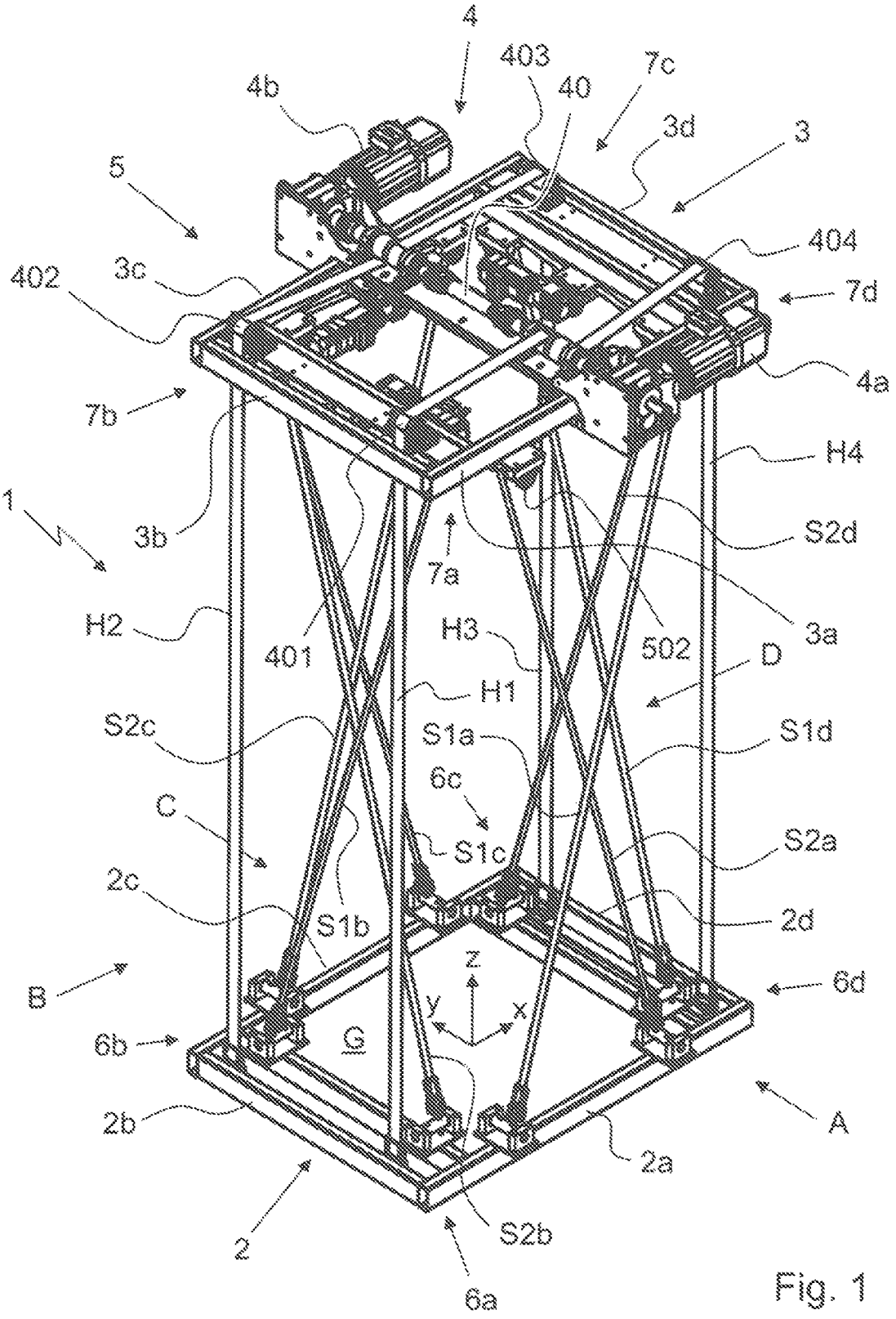
FIG. 1 is a perspective view of a lifting apparatus according to the invention.

FIG. 1 is a perspective view of a lifting apparatus 1 according to the invention. The lifting apparatus 1 comprises two frame assemblies 2, 3 which each extend so as to be substantially in parallel with a ground plane G stretching between a longitudinal direction x and a transverse direction y. In this case, the two frame assemblies 2, 3 are arranged directly above one another with respect to a vertical direction z extending perpendicularly to the ground plane. The lower frame assembly 2 shown at the lower edge in the view in FIG. 1 is suspended, due to gravity, on the upper frame assembly 3, with respect to said lower frame assembly, by individual lifting traction means H1-H4. This arrangement makes it possible for the lower frame assembly 2 to be drawn up towards the upper frame assembly 3, in a manner in parallel with the vertical direction z, by means of winding (not shown in greater detail here) the individual lifting traction means H1-H4 using a raising/lowering device 4. The subsequent lowering of the lower frame assembly 2, taking place in the opposite direction, counter to the vertical direction z, is achieved by correspondingly unwinding the traction means H1-H4 that were previously wound at least in part.

Each frame assembly 2, 3 comprises four lateral portions 2*a*-2*d*; 3*a*-3*d* that enclose a rectangular shape, the lateral portions 2*a*-2*d* of the lower frame assembly 2 being arranged counter to the vertical direction z, below the lateral portions 3*a*-3*d* of the upper frame assembly 3. As a result, in each case two mutually associated lateral portions 2*a*, 3*a*; 2*b*, 3*b*; 2*c*, 3*c*; 2*d*, 3*d* together span therebetween a rectangular lateral plane A-D in each case. In the present case, the raising/lowering device 4 located in the region of the upper frame assembly 3 comprises a total of two lifting drives 4*a*, 4*b* that are coupled for torque transmission to a lifting shaft 40. In this case, the lifting traction means H1-H4 are connected to the lifting shaft 40 such that said means can be wound around the lifting shaft 40 at least in part. The deflections 401-404 of the lifting traction means H1-H4 required therefor can be seen more clearly in FIG. 2 and will be explained in greater detail in the following associated description of said figure. The lifting shaft 40 may be integral or, as can be seen in the present case, formed in multiple parts. The individual portions of the lifting shaft 40 can preferably be interconnected for torque transmission by means of joints.

As well as the lifting traction means H1-H4 designed for raising and lowering, i.e. for lifting, further traction means in the form of oblique traction means S1*a*-S1*d*, S2*a*-S2*d* are provided, which oblique traction means likewise extend between the two frame assemblies 2, 3, but so as to be inclined relative to the vertical direction z in each case. In this case, the individual oblique traction means S1*a*-S1*d*, S2*a*-S2*d* are oriented and arranged relative to one another such that two of the oblique traction means S1*a*, S2*a*; S1*b*, S2*b*; S1*c*, S2*c*; S1*d*, S2*d* mutually intersect in each case. It can be seen that, in this case, the two oblique traction means S1*a*, S2*a* mutually intersect in parallel with the lateral plane A, the two oblique traction means S1*b*, S2*b* mutually intersect in parallel with the lateral plane B, the two oblique traction means S1*c*, S2*c* mutually intersect in parallel with the lateral plane C, and the two oblique traction means S1*d*, S2*d* mutually intersect in parallel with the lateral plane D. This crossover results in the lower frame assembly 2 being stabilized with respect to the upper frame assembly 3, in the possible deflection direction, for example in parallel with the longitudinal direction x and/or transverse direction y, relative to said upper frame assembly.

All the oblique traction means S1*a*-S1*d*, S2*a*-S2*d* are connected to a tensioning device 5 and can be wound and unwound thereby such that, during winding and unwinding of the lifting traction means H1-H4, the tensioning device 5 can retain the oblique traction means S1*a*-S1*d*, S2*a*, S2*d* under sufficient tensile stress (in a manner not shown in greater detail) for the purpose of stabilization.

Both the lifting traction means H1-H4 and the oblique traction means S1*a*-S1*d*, S2*a*-S2*d* are all rigidly attached to the lower frame assembly 2. The fastenings required therefor are in each case arranged in the region of one of the lower corner 6*a*-6*d* located between two of the lateral portions 2*a*-2*d* of the lower frame assembly 2. From there, the lifting traction means H1-H4 each extend in parallel with the vertical direction z as far as a region of one of the upper corners 7*a*-7*d* located between two of the lateral portions 3*a*-3*d* of the upper frame assembly 3 in each case. In contrast, the oblique traction means S1*a*-S1*d*, S2*a*-S2*d* extend quasi diagonally from a region of a lower corner 6*a*-6*d* up to the opposite corner 7*a*-7*d* of the upper frame assembly 3 that is in parallel with the longitudinal direction x or the transverse direction y.

Figure 2:
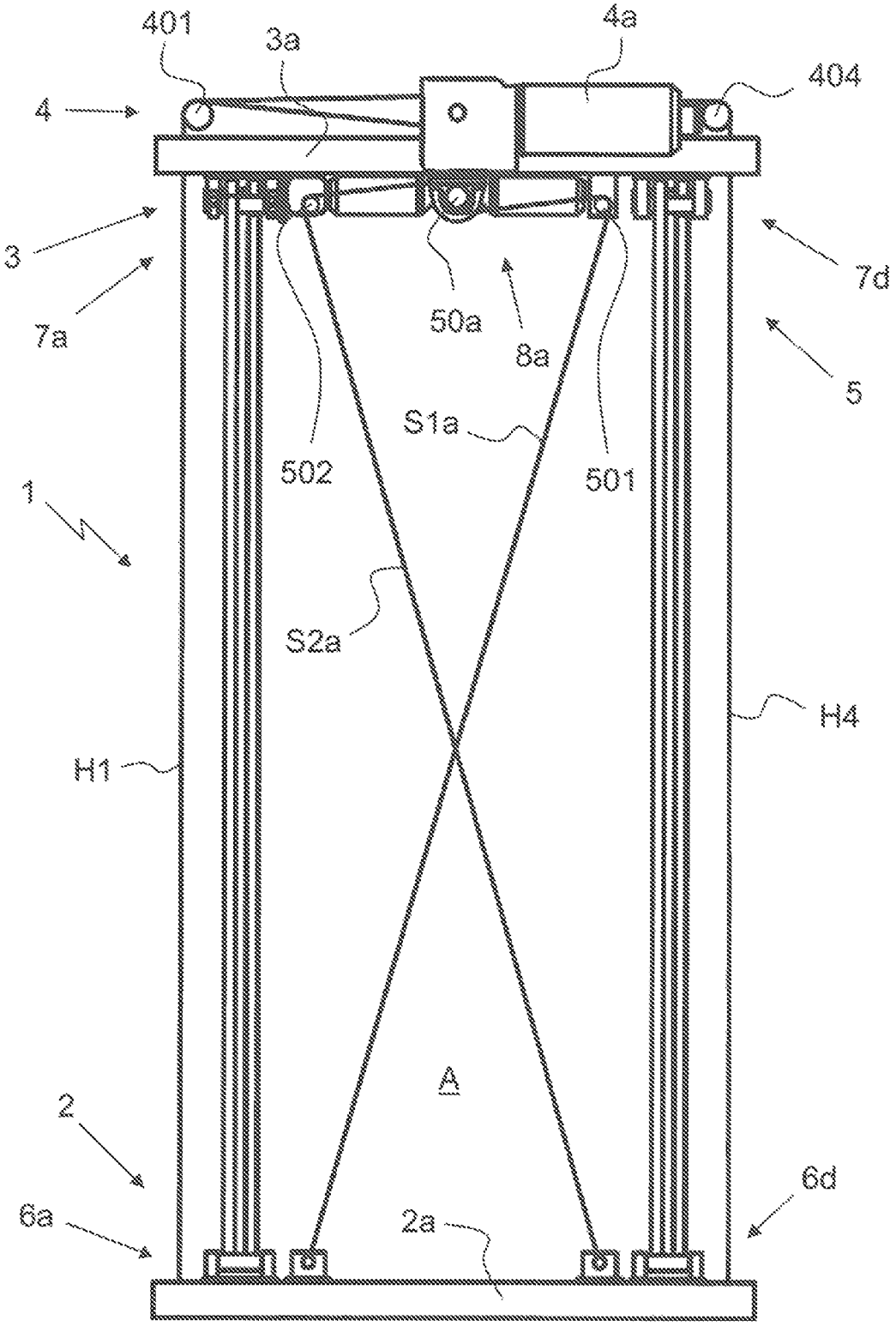
FIG. 2 is a first side view of the lifting apparatus from FIG. 1.

FIG. 2 is a first side view of the lifting apparatus 1 from FIG. 1, seen from the lateral plane A. As can be seen, the oblique traction means S1*a* fastened to the lower frame assembly 2 is guided diagonally from a region of the lower corner 6*a* up to a region of the upper corner 7*d* of the upper frame assembly 3, and is deflected from there, via a deflection 501, to a central portion 8*a* of the lateral portion 3*a*. In a virtually mirrored manner, the other oblique traction means S2*a* is also guided diagonally from a region of the opposite lower corner 6*d* up to a region of the opposite upper corner 7*a* of the upper frame assembly 3, and from there is likewise deflected, via a deflection 502, to the central portion 8*a* of the lateral portion 3*a*. A tensioning shaft 50*a* of the tensioning drive 5 is arranged in the region of the central portion 8*a*, to which shaft the two oblique traction means S1*a*, S2*a* are connected accordingly.

In the same way, the oblique traction means S1*c*, S2*c* (not visible here) are each deflected, in the region of the opposite lateral plane C, about a deflection 503, 504, towards a tensioning shaft 50*c* of the tensioning device 5 arranged in the region of the central portion 8*c* of the associated lateral portion 3*c* and are connected to said shaft.

FIG. 2 is a further side view of the lifting apparatus 1 from FIGS. 1 and 2, seen from the lateral plane D. As can be seen, in a manner analogous to the above description, the oblique traction means S1*d* fastened to the lower frame assembly 2 is guided diagonally from a region of the lower corner 6*d* up to a region of the upper corner 7*c* of the upper frame assembly 3, and is deflected from there, via a deflection 505, to a central portion 8*d* of the lateral portion 3*d*. In a likewise mirrored manner in this case, the other oblique traction means S2*d* is also guided diagonally from a region of the opposite lower corner 6*c* up to a region of the opposite upper corner 7*d* of the upper frame assembly 3, and from there is likewise deflected, via a deflection 506, to the central portion 8*d* of the lateral portion 3*a*. A further tensioning shaft 50*d* of the tensioning drive 5 is arranged in the region of the central portion 8*d*, to which shaft the two oblique traction means S1*d*, S2*d* are connected accordingly.

In the same way, the oblique traction means S1*b*, S2*b* (not visible here) are each deflected, in the region of the opposite lateral plane B, about a deflection 507, 508, towards a tensioning shaft 50*b* of the tensioning device 5 arranged in the region of the central portion 8*b* of the associated lateral portion 3*b* and are connected to said shaft.

Figure 3:
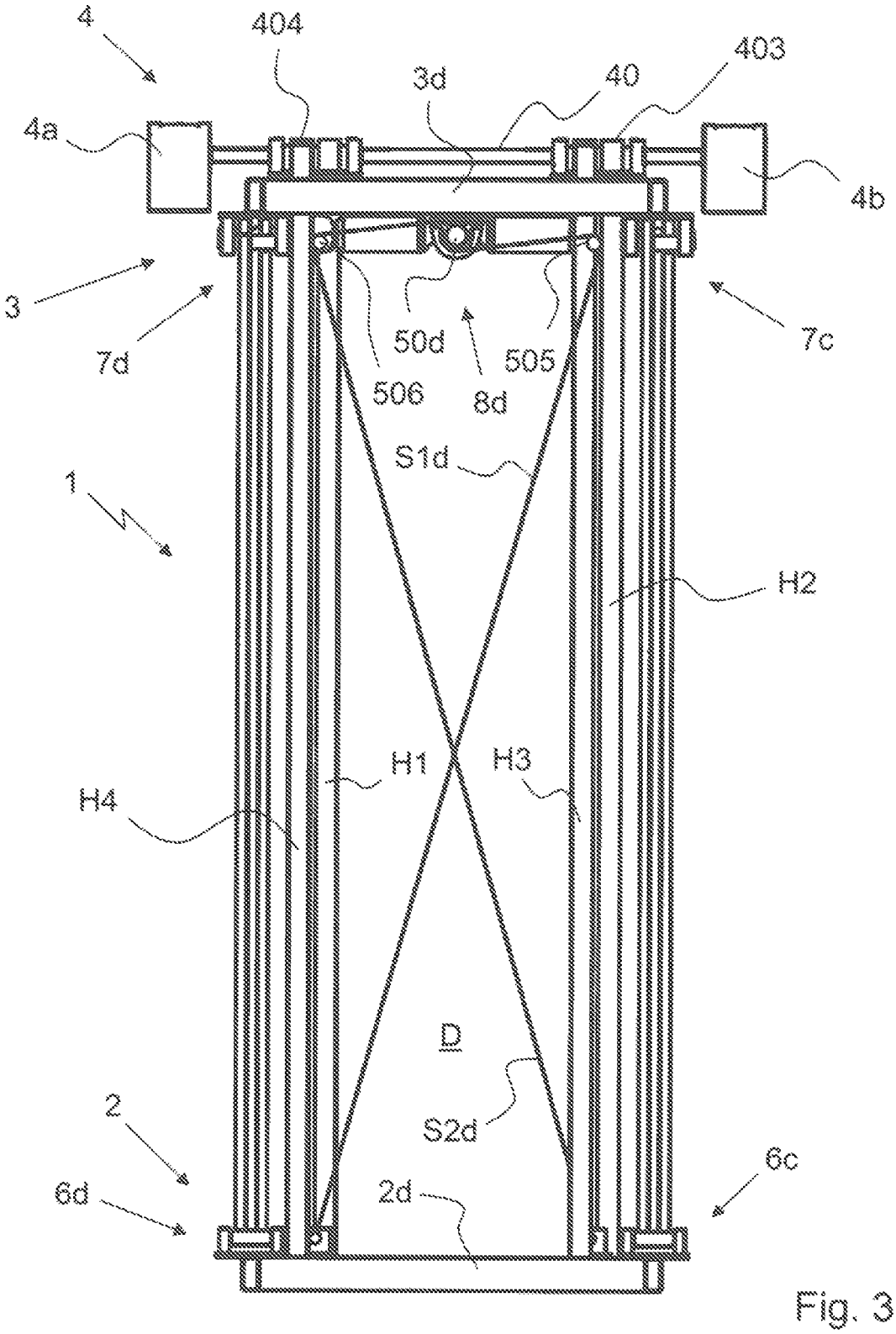
FIG. 3 is a further, second side view of the lifting apparatus from FIGS. 1 and 2.
Figure 4:
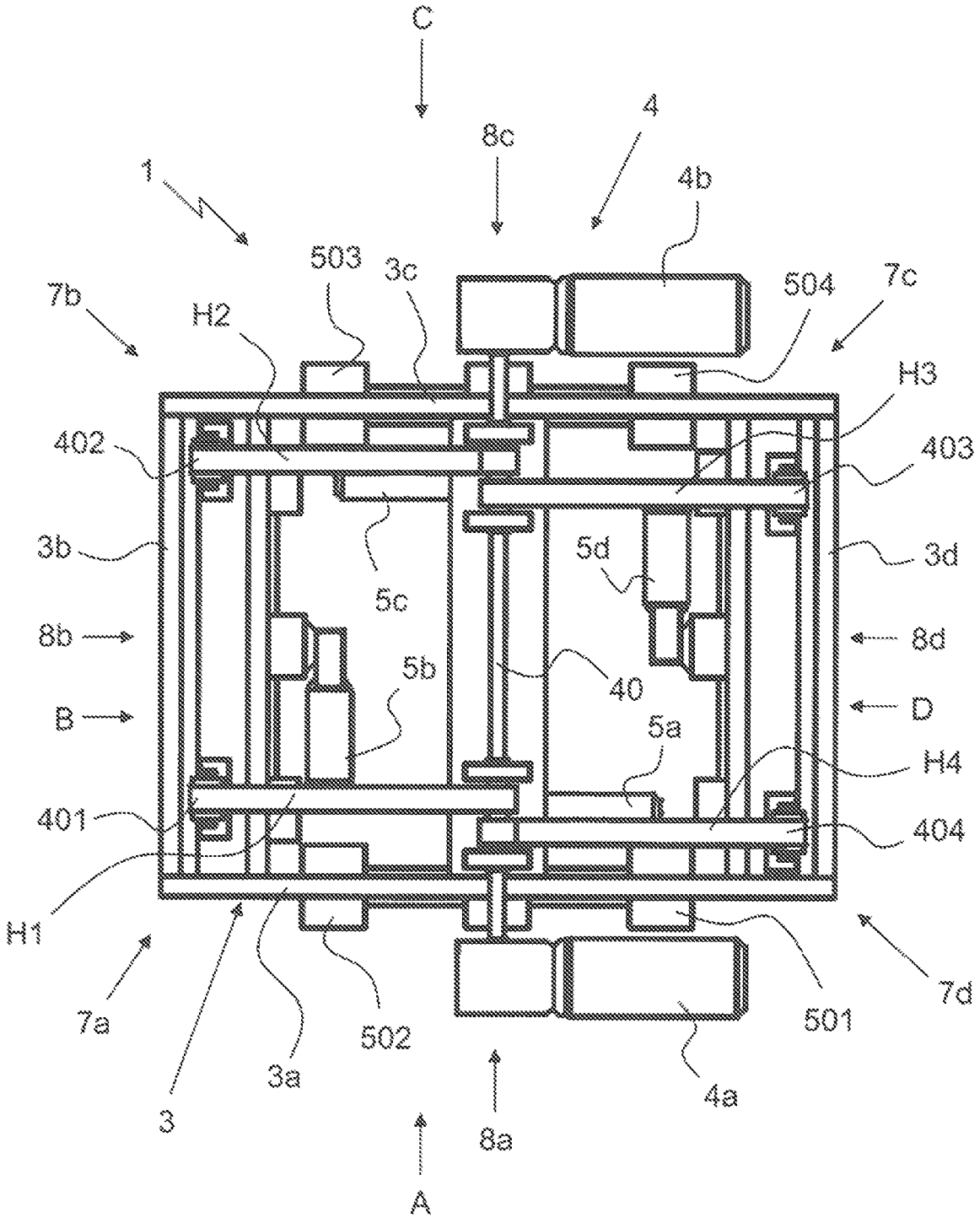
FIG. 4 is a plan view of the lifting apparatus from FIGS. 1 to 3.

FIG. 4 is a plan view of the lifting apparatus 1 of FIGS. 1 to 3; more precisely of the upper frame assembly 3 thereof. The deflection of the four lifting traction means H1-H4 towards the lifting shaft 40 of the raising/lowering device 4 is again illustrated in greater detail here.

It can be seen that said traction means are in each case deflected towards the two central portions 8*a*, 8*c* of the associated lateral portions 3*a*, 3*b*, between which the lifting shaft 40 extends. Four mutually separated tensioning drives 5*a*-5*d* of the tensioning device 5 which are each connected for torque transmission to one of the four tensioning shafts 50*a*-50*d* can also be seen. The tensioning shafts 50*a*-50*d* may in each case be a drive shaft of the associated tensioning drive 5*a*-5*d*.

Figure 5:
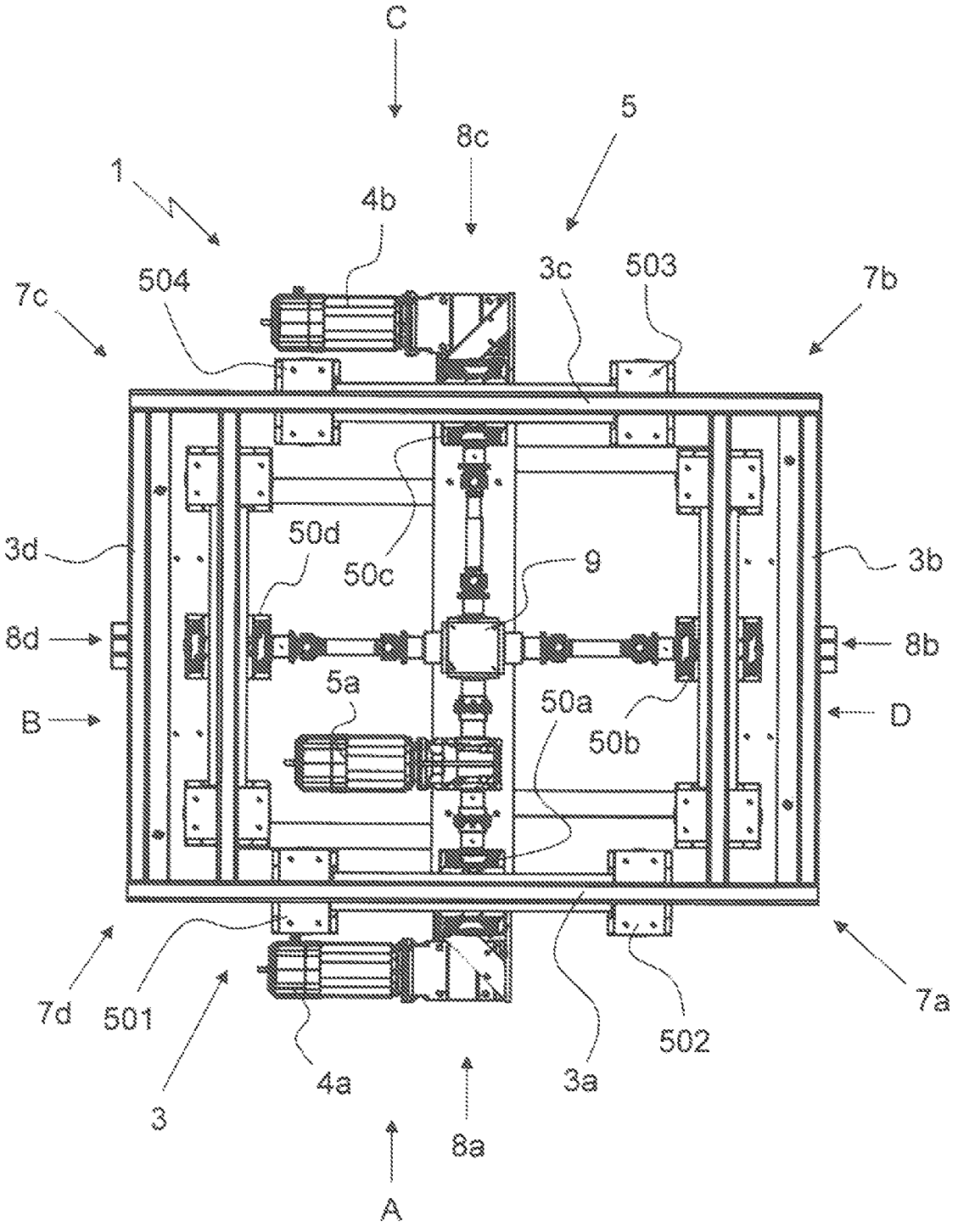
FIG. 5 is a view from below, under an upper part of the lifting apparatus from FIGS. 1 to 4, in an alternative embodiment to the view in FIG. 4.

FIG. 5 shows an alternative embodiment of the tensioning device 5. In the view from below shown here, seen from below the upper frame assembly 3 in the vertical direction z, it can be seen that just one tensioning drive 5*a* is provided. In this case, the individual tensioning shafts 50*a*-50*d* are coupled together by means of a transmission unit 9 located in the center of the upper frame assembly 3. In this case, the one tensioning drive 5*a* is integrated between one of the tensioning shafts 50*a* and the transmission unit 9. In this way, the torque transmitted from the tensioning drive 5*a* to the tensioning shaft 50*a* is transmitted synchronously to the remaining tensioning shafts 50*b*-50*d*. It can be seen that the individual tensioning shafts 50*a*-50*d* are coupled to the transmission unit 9 and the tensioning drive 5*a* by means of interposing further shaft components.

LIST OF REFERENCE SIGNS

1 lifting apparatus
2 lower frame assembly of 1
2*a* lateral portion of 2
2*b* lateral portion of 2
2*c* lateral portion of 2
2*d* lateral portion of 2
3 upper frame assembly of 1
3*a* lateral portion of 3
3*b* lateral portion of 3
3*c* lateral portion of 3
3*d* lateral portion of 3
4 raising/lowering device of 1
4*a* lifting drive of 4
4*b* lifting drive of 4
5 tensioning device of 1
5*a* tensioning drive of 5
5*b* tensioning drive of 5
5*c* tensioning drive of 5
5*d* tensioning drive of 5
6*a* lower corner between 2*a* and 2*b*
6*b* lower corner between 2*b* and 2*c*
6*c* lower corner between 2*c* and 2*d*
6*d* lower corner between 2*d* and 2*a*
7*a* upper corner between 3*a* and 3*b*
7*b* upper corner between 3*b* and 3*c*
7*c* upper corner between 3*c* and 3*d*
7*d* upper corner between 3*d* and 3*a*
8*a* central portion of 3*a*
8*b* central portion of 3*b*
8*c* central portion of 3*c*
8*d* central portion of 3*d*
9 transmission unit between 50*a*-50*d*
40 lifting shaft of 4
50*a* tensioning shaft of 5
50*b* tensioning shaft of 5
50*c* tensioning shaft of 5
50*d* tensioning shaft of 5
401 deflection for H1
402 deflection for H2
403 deflection for H3
404 deflection for H4
501 deflection for S1*a*
502 deflection for S2*a*
503 deflection for S1*c*
504 deflection for S2*c*
505 deflection for S1*d*
506 deflection for S2*d*
507 deflection for S1*b*
508 deflection for S2*b*
A lateral plane of 1
B lateral plane of 1
C lateral plane of 1
D lateral plane of 1
H1 lifting traction means
H2 lifting traction means
H3 lifting traction means
H4 lifting traction means
S1*a* oblique traction means
S1*b* oblique traction means
S1*c* oblique traction means
S1*d* oblique traction means
S2*a* oblique traction means
S2*b* oblique traction means
S2*c* oblique traction means
S2*d* oblique traction means
G ground plane
X longitudinal direction
Y transverse direction
Z vertical direction

What is claimed is:

1. A lifting apparatus for raising and lowering in particular heavy objects, comprising:

two frame assemblies that are positioned one above the other with respect to a vertical direction (z), the lower frame assembly of which is suspended on the upper frame assembly using lifting traction means, whereby winding of the lifting traction means allows the lower frame assembly to be drawn up towards the upper frame assembly by means of a raising/lowering device, and subsequent unwinding of the lifting traction means allows said lower frame assembly to be lowered relative to the upper frame assembly; and oblique traction means that extend between the two frame assemblies and can be wound and unwound using a tensioning device, two of the oblique traction means mutually intersecting such that the lower frame assembly is stabilized, relative to the upper frame assembly, in at least one deflection direction that extends transversely to the vertical direction (z), the tensioning device being able to retain each of the oblique traction means under tensile stress during winding and unwinding of the lifting traction means, wherein the tensioning device comprises four tensioning drives which are each coupled to one tensioning shaft, at least two of the oblique traction means in each case being able to be wound around one of the four tensioning shafts at least in part.

2. The lifting apparatus according to claim 1, wherein the frame assemblies each comprise at least three lateral portions, at least two of the oblique traction means mutually intersect and extend between at least one of the lateral portions of the lower frame assembly and a lateral portion of the upper frame assembly that is located thereabove with respect to the vertical direction (z).

3. The lifting apparatus according to claim 2, wherein the at least two mutually intersecting oblique traction means extend between each of the lateral portions of the lower frame assembly and the lateral portion of the upper frame assembly that is located thereabove with respect to the vertical direction (z).

4. The lifting apparatus according to claim 1, wherein the raising/lowering device comprises at least one lifting drive which is coupled to a lifting shaft, the lifting traction means being able to be wound around the lifting shaft at least in part.

5. The lifting apparatus according to claim 1, wherein the at least one of the four tensioning drives is coupled to at least one tensioning shaft, at least two of the oblique traction means being able to be wound around the tensioning shaft at least in part.

6. The lifting apparatus according to claim 5, wherein at least one of the four tensioning drives is coupled to at least two tensioning shafts, in each case at least two of the oblique traction means each being able to be wound around one of the two tensioning shafts, at least in part.

7. The lifting apparatus according to claim 5, wherein at least one of the four tensioning drives is coupled to four tensioning shafts, in each case at least two of the oblique traction means each being able to be wound around one of the four tensioning shafts, at least in part.

8. The lifting apparatus according to claim 1, wherein each of the oblique traction means is rigidly attached to the lower frame assembly in the region of a lower corner located between two of the lateral portions thereof in each case, one the lateral portions of the lower frame assembly in each case, and the lateral portion of the upper frame assembly that is located thereabove with respect to the vertical direction (z) together spanning a lateral plane (A-D), and each of the oblique traction means extending diagonally, within a plane extending in parallel with the associated lateral plane (A-D), from the lower frame assembly towards the upper frame assembly as far as a region of an upper corner located between two of the lateral portions in each case.

9. The lifting apparatus according to claim 8, wherein each of the oblique traction means is hinged, on the upper frame assembly, to a central portion of the relevant lateral portion, each of the oblique traction means then being connected to a tensioning shaft of the tensioning device located in the region of the associated central portion.

10. The lifting apparatus according to claim 1, wherein each of the lifting traction means is rigidly attached to the lower frame assembly in a region of a lower corner located between two of the lateral portions thereof in each case, each of the lifting traction means extending towards the upper frame assembly in parallel with the vertical direction (z).

11. The lifting apparatus according to claim 10, wherein each of the lifting traction means is hinged, on the upper frame assembly, to a central portion of the relevant lateral portion, each of the lifting traction means being connected to a lifting shaft of the raising/lowering device located in the region of the associated central portion.

12. The lifting apparatus according to claim 1, wherein the lifting traction means and/or the oblique traction means are formed as a belt, band or cable, or comprise at least one of said structures.

* * * * *